US005785510A

United States Patent [19]

Altieri, Jr. et al.

[11] Patent Number: 5,785,510

[45] Date of Patent: Jul. 28, 1998

[54] GEAR PUMP HAVING MEMBERS WITH DIFFERENT HARDNESSES

[75] Inventors: Anthony Altieri, Jr., Wheeling; John Lewis Fortin, Gurnee; Richard David Bothmann, Palatine, all of Ill.; Sandra Jean Liakus, Fort Wayne, Ind.; Philip DiGangi, Schaumburg; Dietrich M. E. Heyde, Naperville, both of Ill.

[73] Assignee: Fluid Management Limited Partnership, Wheeling, Ill.

[21] Appl. No.: 779,481

[22] Filed: Jan. 7, 1997

Related U.S. Application Data

[62] Division of Ser. No. 681,320, Jul. 22, 1996, Pat. No. 5,697,527, which is a continuation of Ser. No. 299,610, Sep. 1, 1994, abandoned.

[51] Int. Cl.[6] ..... F04C 2/10

[52] U.S. Cl. ..... 418/104; 418/152; 418/169; 418/170; 418/179

[58] Field of Search ..... 418/104, 152, 418/169, 170, 179

[56] References Cited

U.S. PATENT DOCUMENTS

| | | | |
|---|---|---|---|
| 1,877,688 | 9/1932 | Petersen | 418/169 |
| 2,724,581 | 11/1955 | Pahl et al. | 222/135 X |
| 2,923,438 | 2/1960 | Logan et al. | 222/132 X |
| 3,008,425 | 11/1961 | Chambers | 418/179 |
| 3,096,720 | 7/1963 | Younger | 418/179 |
| 3,117,527 | 1/1964 | Messmer | 418/179 |
| 3,443,522 | 5/1969 | Schindler | 418/169 |
| 3,704,968 | 12/1972 | Haupt | 418/179 |
| 3,712,767 | 1/1973 | Beutter | 418/179 |
| 3,825,377 | 7/1974 | Bottoms | 418/179 |
| 3,851,798 | 12/1974 | Miller | 222/135 |
| 4,027,783 | 6/1977 | Branch et al. | 222/135 X |
| 5,078,302 | 1/1992 | Hellenberg | 222/135 X |
| 5,119,973 | 6/1992 | Miller et al. | 222/135 X |
| 5,129,551 | 7/1992 | Gott | 222/135 |
| 5,180,297 | 1/1993 | Hansen et al. | 418/169 |
| 5,460,297 | 10/1995 | Shannon et al. | 122/135 |

FOREIGN PATENT DOCUMENTS

| | | | |
|---|---|---|---|
| 3045192 | 6/1982 | Germany | 418/152 |

OTHER PUBLICATIONS

"Miller3 s Accutinters™ are upgraded with automatic calibration feature," Product Brochure #RA88169, one page, Miller Paint Equipment, Ltd.™, Addison IL (undated, but believed to be prior art with respect to the subject invention).

Miller "Accutinter™ 3000 Colorant Dispenser," 2-page brochure, RA9019/ACC3000 Printed in U.S.A., Miller Manufacturing®, A Division of Fluid Management Limited Partnership, Addison, IL (undated, but believed to be prior art with respect to the subject invention).

Miller "Accutinter™ 300 Colorant Dispenser," 2-page brochure, RA9019/ACC300 Printed in U.S.A., Miller Manufacturing®, A Division of Fluid Management Limited Partnership, Addison, IL (undated, but believed to be prior art with respect to the subject invention).

Miller Accutinters®, 2-page brochure, Printed in the U.S.A. RA9046/ACCHIGH, Miller Manufacturing®, A Division of Fluid Management Limited Partnership, Addison, IL (undated, but believed to be prior art with respect to the subject invention).

*Primary Examiner*—John J. Vrablik

*Attorney, Agent, or Firm*—Fitch, Even, Tabin & Flannery

[57] ABSTRACT

An improved gear pump having members with different hardnesses includes a housing defining an internal bore with inlet and outlet passageways. A head member includes a wall between the inlet and outlet passageways and extends toward a toothed rotor. A toothed idler gear meshes with the rotor. The head member and idler gear are made of materials having a hardness greater than that of the rotor material. In one embodiment the idler gear is made of ceramic material whereas the head member and rotor are made of cast iron, with the head member treated to have a hardness greater than that of the rotor.

8 Claims, 12 Drawing Sheets

10
12
82
24
83
80
74
78
30
34
26
32
36
16
20
18
14

10
24
44
34
30
26
18
14
20
16

72
24
270
246
240
250
60
244
270
264
44
262
34
30
32
280
56
260
58
268
282
68
50
268
68
66
54
52
54

Fig. 11
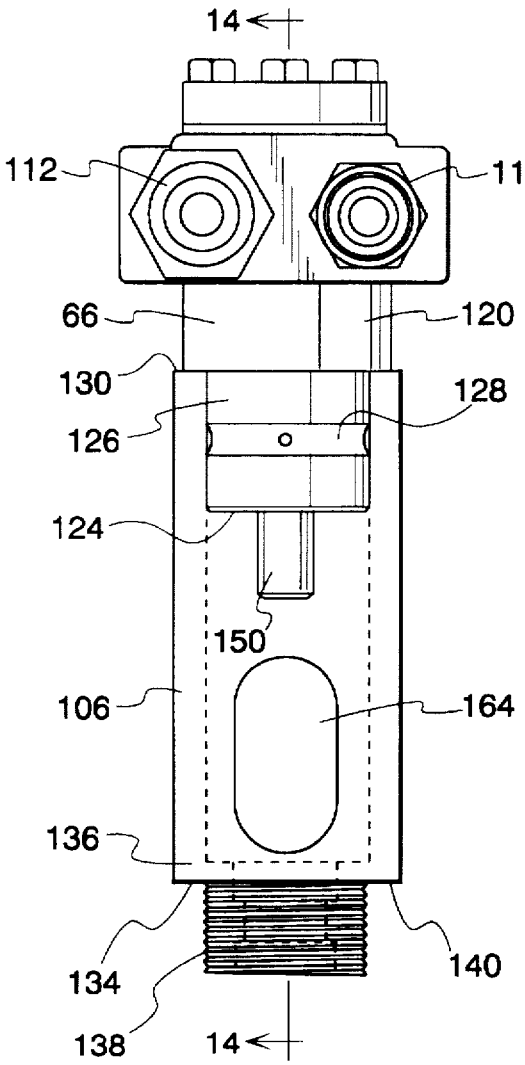
Fig. 12
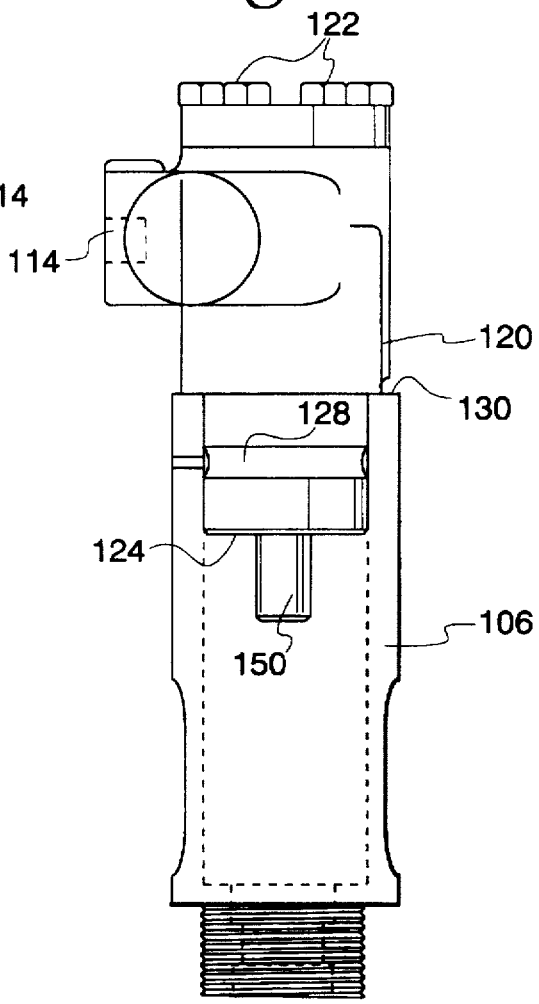
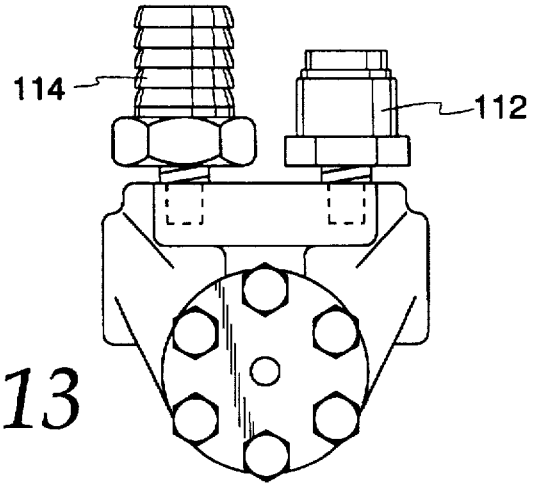
Fig. 13

Fig. 17
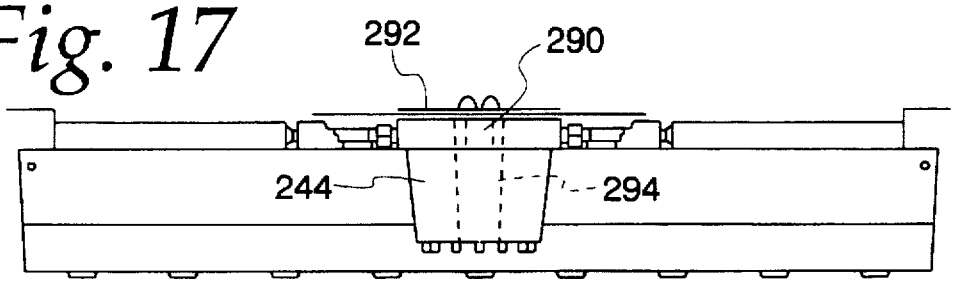
Fig. 18
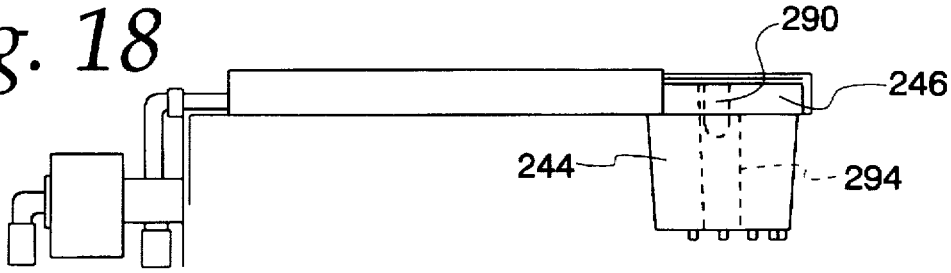
Fig. 19
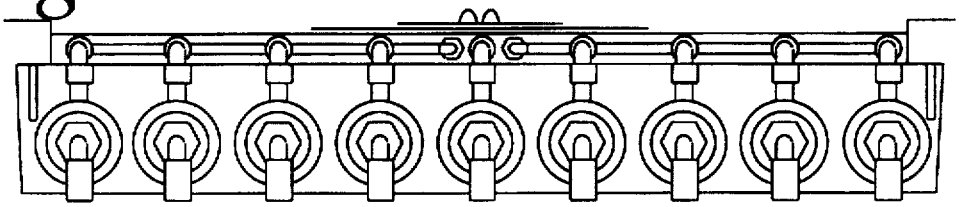
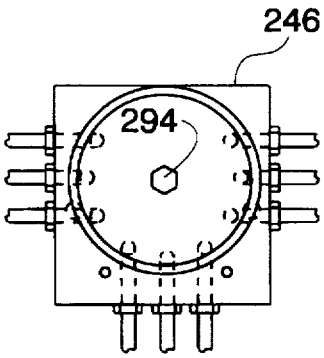
Fig. 20
Fig. 21
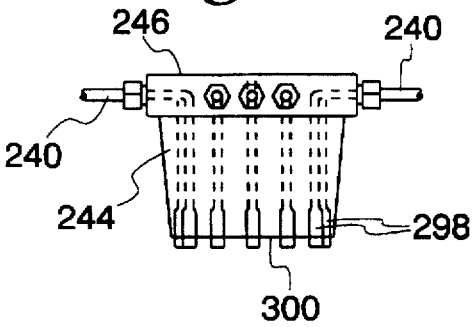
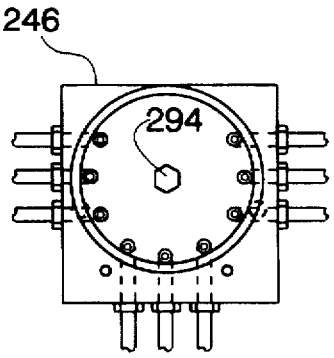
Fig. 22

GEAR PUMP HAVING MEMBERS WITH DIFFERENT HARDNESSES

This is a division of application Ser. No. 08/681,320, filed Jul. 22, 1996, U.S. Pat. No. 5,697,527, which in turn is a file wrapper continuation of application Ser. No. 08/299,610, filed Sep. 1, 1994, abandoned.

BACKGROUND OF THE INVENTION

1. Field of the Invention

The present invention pertains to dispensing apparatus, and in particular to apparatus for dispensing fluids and other flowable materials.

2. Description of the Related Art

Over the years, the assignee of the present invention has developed dispensers for liquid colorants and other commercially important materials. Examples of automatic dispensers are given in U.S. Pat. No. 3,851,798 and U.S. Design Pat. Nos. 262,628 and 262,629. Dispensers of this type typically have the capability to receive instructions designating a selected formulation, and to dispense the ingredients called for in the formulation. Dispensing is carried out by pump assemblies which are located at the bottom of the dispensing machine, behind an array of canisters. A fluid coupling line extends from the pump assemblies to passageways formed in a nozzle member, where the ingredients leave the dispenser apparatus. In other types of dispensing machines, developed later, dispensing valves are located remote from the pumping units, in the general vicinity of a dispense head, and, for this reason, and for a number of other factors, different dispensing characteristics are observed among the different systems.

Retail stores undergo continuing pressures to increase the density of products displayed and made available to consumers for carrying to a checkout area. Paint departments of retail stores, for example, are seeking more compact dispensing machines, and in particular compact machines having a reduced "footprint," requiring less floor space than previous models. Because of assembly costs and the impact of component location on dispensing performance, considerable care must be taken when reducing the overall size of a dispensing machine.

As will be readily appreciated by those skilled in the art, dispensing machines employ a substantial number of components which must be maintained, and sometimes adjusted, throughout the life of the machine. It is important that field service personnel have ready access to all of the machine's parts and especially critical components, such as dispense valves and components associated with the dispense valves for metering material required by a user of the machine. The pumps employed in dispensing machines are typically driven by one or more electric motors through some sort of intermediate mechanical transmission system. Moving parts are subject to wear during the life of the machine, and provision must be made for their servicing.

During the construction of a complicated machine, such as dispensers of the above-mentioned type, various components are mounted within a framework to which an outer "skin" (oftentimes comprising sheet metal panels) is applied. Alternatively, the outer skin may be applied to the framework to form a cabinet within which the components are installed. As a machine is constructed, various components are accumulated and installed in a sequence which minimizes labor investment in the machine. Because of the nature of a commercial dispensing machine, many of the components of the machine comprise duplicates of the same part. For example, dispensing machines, especially those used in the coatings industry, dispense multiple materials, as many as sixteen different colorant materials, and oftentimes as many as nine or twelve different colorant materials. Each colorant material has its own "fluid circuit" typically originating with a canister in which fluid material is stored and terminating with the dispense head in which fluid material leaves the dispenser. Fluid circuits typically include, in addition to the aforementioned canisters, pumps, valves and intermediate fluid lines. Certain advantages can be attained if similar components are associated together in subassemblies which can be tested at one time.

SUMMARY OF THE INVENTION

It is an object of the present invention to provide a dispensing machine in which components of like type are aggregated in functional subassemblies, which can be remotely tested prior to their installation in a dispensing machine.

Another object of the present invention is to reduce the space required for components in a subassembly, employing the advantages of a "bench assembly" wherever possible.

A further object according to principles of the present invention is to provide dispensing apparatus having a reduced "footprint," thereby requiring a lesser amount of floor space, without sacrificing functionality of the machine.

A further object according to principles of the present invention is to provide dispensing apparatus having improved construction which facilitates field servicing and adjustments.

Yet another object according to principles of the present invention is to provide a dispensing machine which can readily accommodate store personnel who must manually position containers of substantial size and weight under a dispense head. For example, in the coatings industry, tinting materials are added to base coatings provided by the manufacture in 5-gallon container sizes. It is an object of the present invention to provide a dispensing machine having a shelf arrangement which required minimum lifting of these and other containers which receive dispense materials.

These and other objects to principles of present invention are provided in a dispensing apparatus, comprising:

- a frame;
- a drive assembly including a base plate and a plurality of pumps mounted on the base plate;
- a first plurality of canisters having top and bottom ends and preselected shorter length, coupled to first ones of the pumps;
- a second plurality of canisters, of preselected longer length and having top and bottom ends and coupled to second ones of the pumps;
- the bottom ends of the first and the second plurality of canisters arranged generally coplanar, immediately above the drive assembly;
- a lower shelf mounted to the frame above the first plurality of canisters and hinged to allow access to the first plurality of canisters;
- a dispense head coupled to the pumps and located above the canisters so as to overhang the lower shelf;
- an access door above the second plurality of canisters and hinged to allow access to the second plurality of canisters;
- an upper shelf extending from the access door so as to be interposed between the lower shelf and the dispense head.

BRIEF DESCRIPTION OF THE DRAWINGS

FIG. 11 is a top plan view of one of the pumps;

FIG. 12 is a side elevational view thereof;

FIG. 13 is a rear elevational view thereof;

FIG. 17 is a front elevational view thereof;

FIG. 18 is a side elevational view thereof;

FIG. 19 is a rear elevational view thereof;

FIG. 20 is a top plan view of a dispense head assembly thereof;

FIG. 21 is a front elevational view thereof; and

FIG. 22 is a bottom plan view thereof.

DETAILED DESCRIPTION OF THE PREFERRED EMBODIMENT

Figure 1:
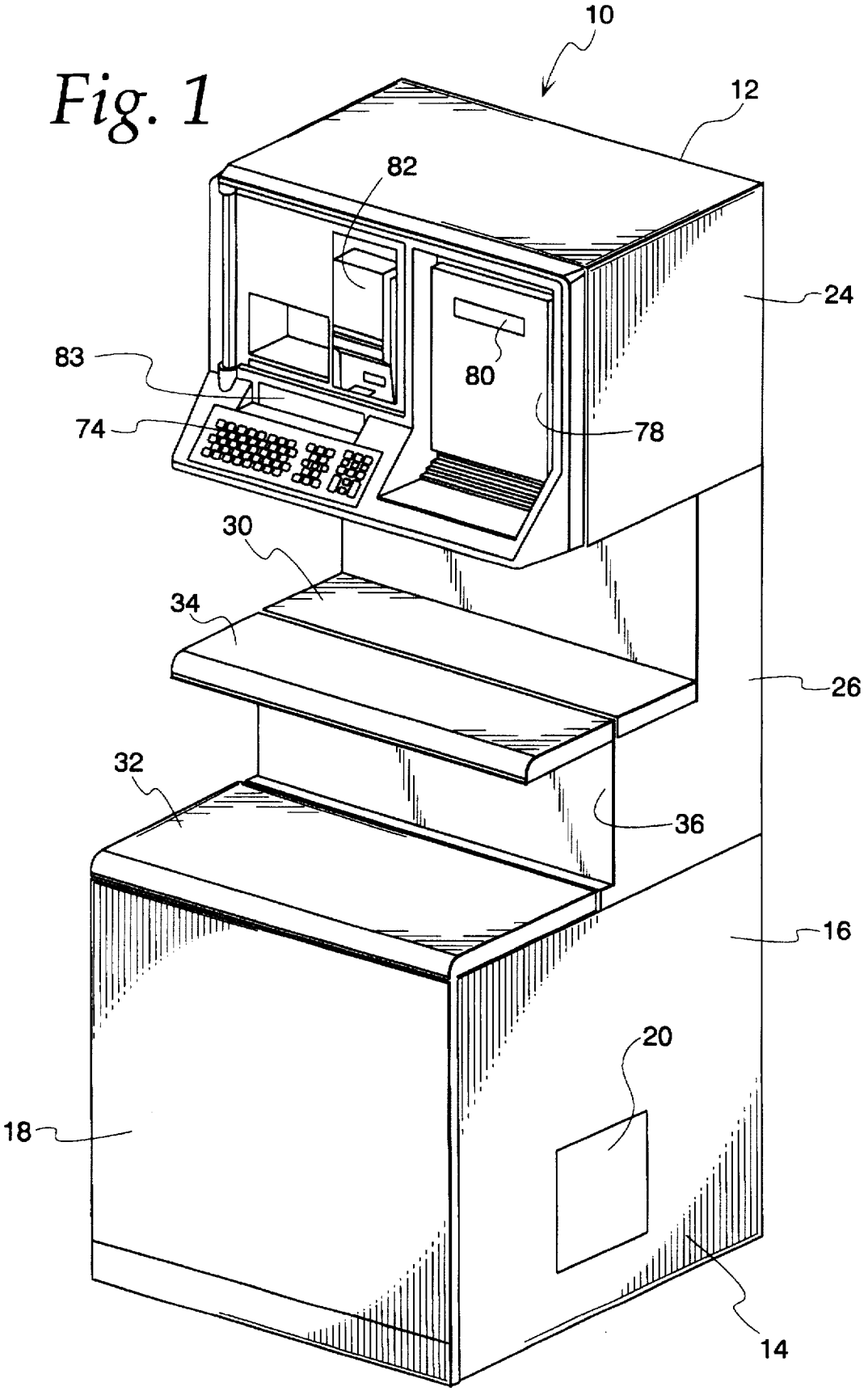
FIG. 1 is a perspective view of dispensing apparatus according to principles of the present invention.
Figure 2:
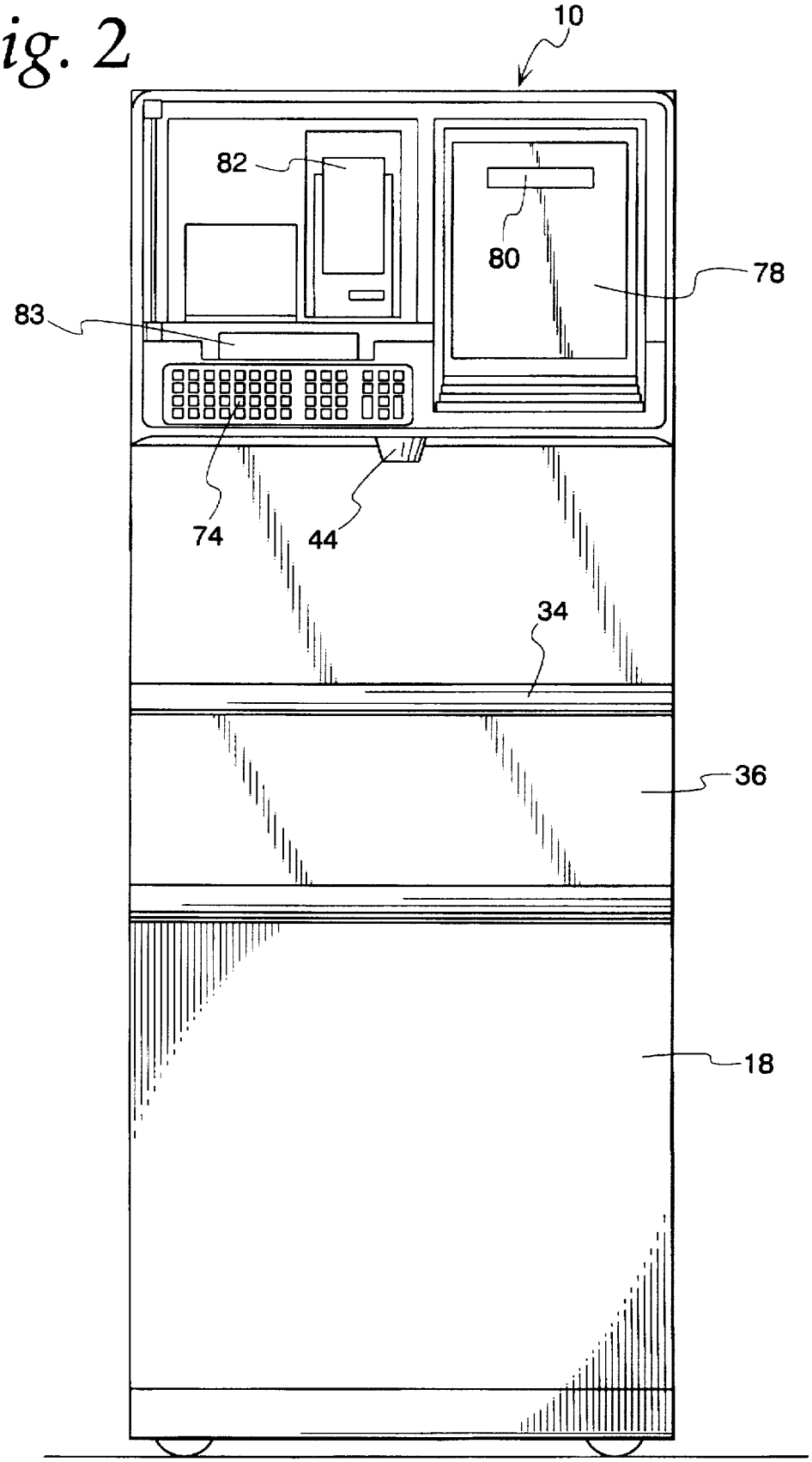
FIG. 2 is a front elevational view thereof.
Figure 3:
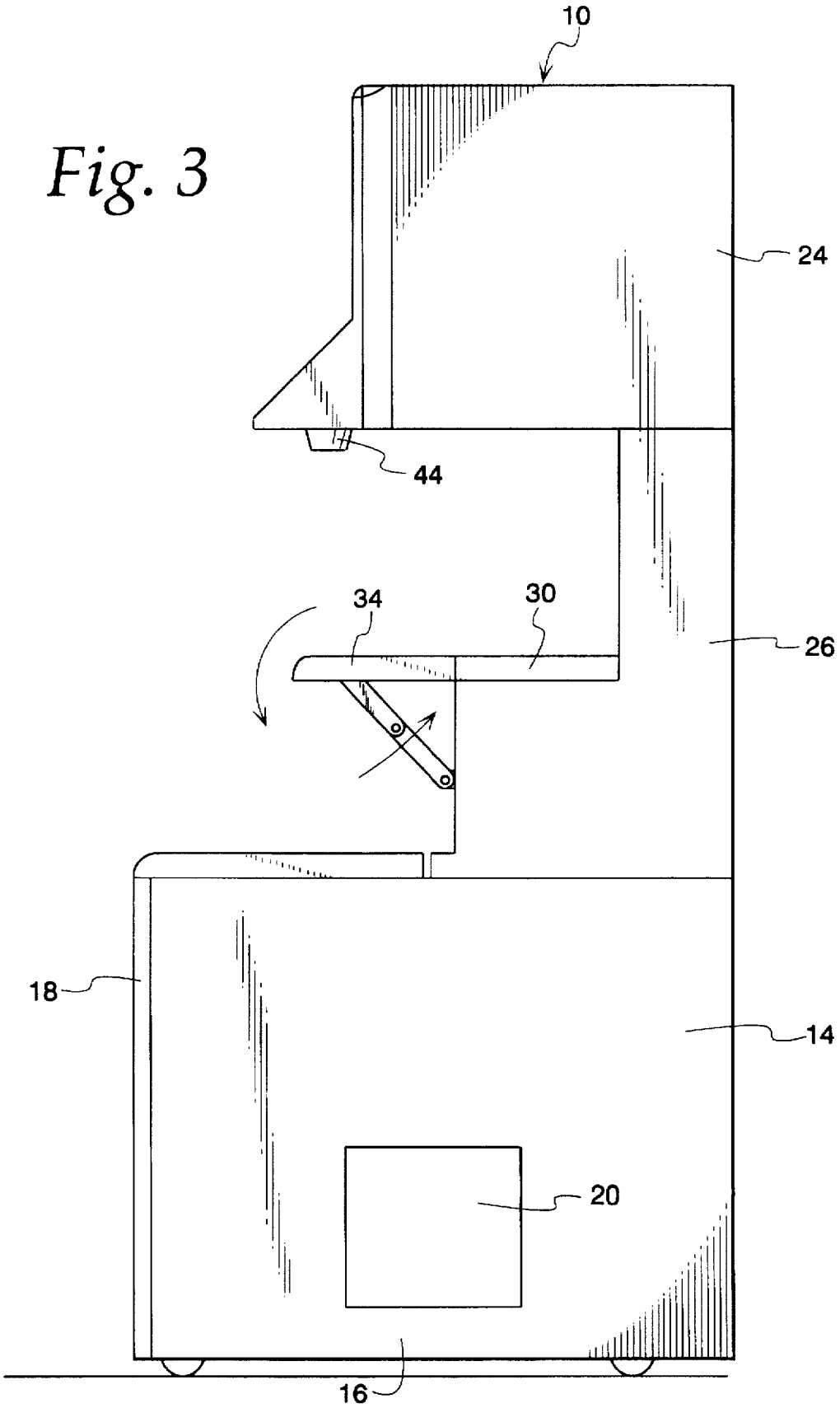
FIG. 3 is a side elevational view thereof.

Referring now to the drawings, and initially to FIGS. 1–3, a dispenser illustrating principles of the present invention is generally indicated at 10. The dispenser 10 has found immediate commercial acceptance in the field of retail and industrial coatings, particularly coatings which are blended on demand, using liquid components. As will be appreciated upon consideration of the following, the dispenser 10 and associated apparatus therein may also be readily adaptable for use with other flowable materials including relatively thick pastes (such as ink pastes), salves, balms, food products and food supplements, as well as lotions and creams for topical applications, for example.

The dispenser 10 includes a cabinet comprising an outer skin, preferably made of sheet metal components, affixed to a framework, preferably of tubular metal construction. The cabinet 12 includes a lower portion 14 including side panels 16 and front panel 18, with access doors 20 formed in the side panel 16. As will be seen herein, the lower cabinet portion 14 encloses most of the storage canisters containing ingredients to be dispensed, pumps and pump drive systems which deliver the materials to a dispense head located in the lower part of upper cabinet portion 24.

Dispenser 10 has a significantly reduced size. In particular, the "footprint" or base of the cabinet 12 is substantially smaller than previous dispensers providing generally the same functionality. As will be seen herein, the space savings results from innovative assembly techniques which also provide substantial labor reduction for both installation and servicing of the dispenser.

Space reduction also results, in part, from the use of different sized canisters, and in particular, canisters of different lengths. A middle section 26 of cabinet 12 houses the upper parts of the taller canisters and also houses tubing coupling the dispense nozzle to pumps located in the lower cabinet portion 14. The middle cabinet portion 26 includes a hinged access door 30 which can be opened, as desired, to service the taller canisters. A lower shelf 32 also serves as a second access door for servicing the shorter canisters located therebelow. Shelf 32 provides a convenient support surface for larger sized containers, allowing the containers to be conveniently positioned underneath the dispense nozzle, located in the overhanging lower portion of the upper cabinet part 24. It has been found expedient, particularly when dispensing paint materials into smaller sized containers, that the small size containers be positioned as close to the dispense nozzle as possible. Accordingly, an upper shelf 34 extends from access door 30 to support the smaller sized containers above the lower shelf 32. When dispensing into larger containers, the upper shelf 34 is hinged to swing out of the way, against front surface 36.

The upper dispenser portion 24 encloses most of the control equipment generally indicated at 72 for the dispenser, including a digital controller, a keyboard for data input, a visual display and printer for data output, and memory units for program and formulation storage. As can be seen in FIGS. 2 and 3, the upper cabinet portion 24 also includes a dispense head assembly 44.

Figure 4:
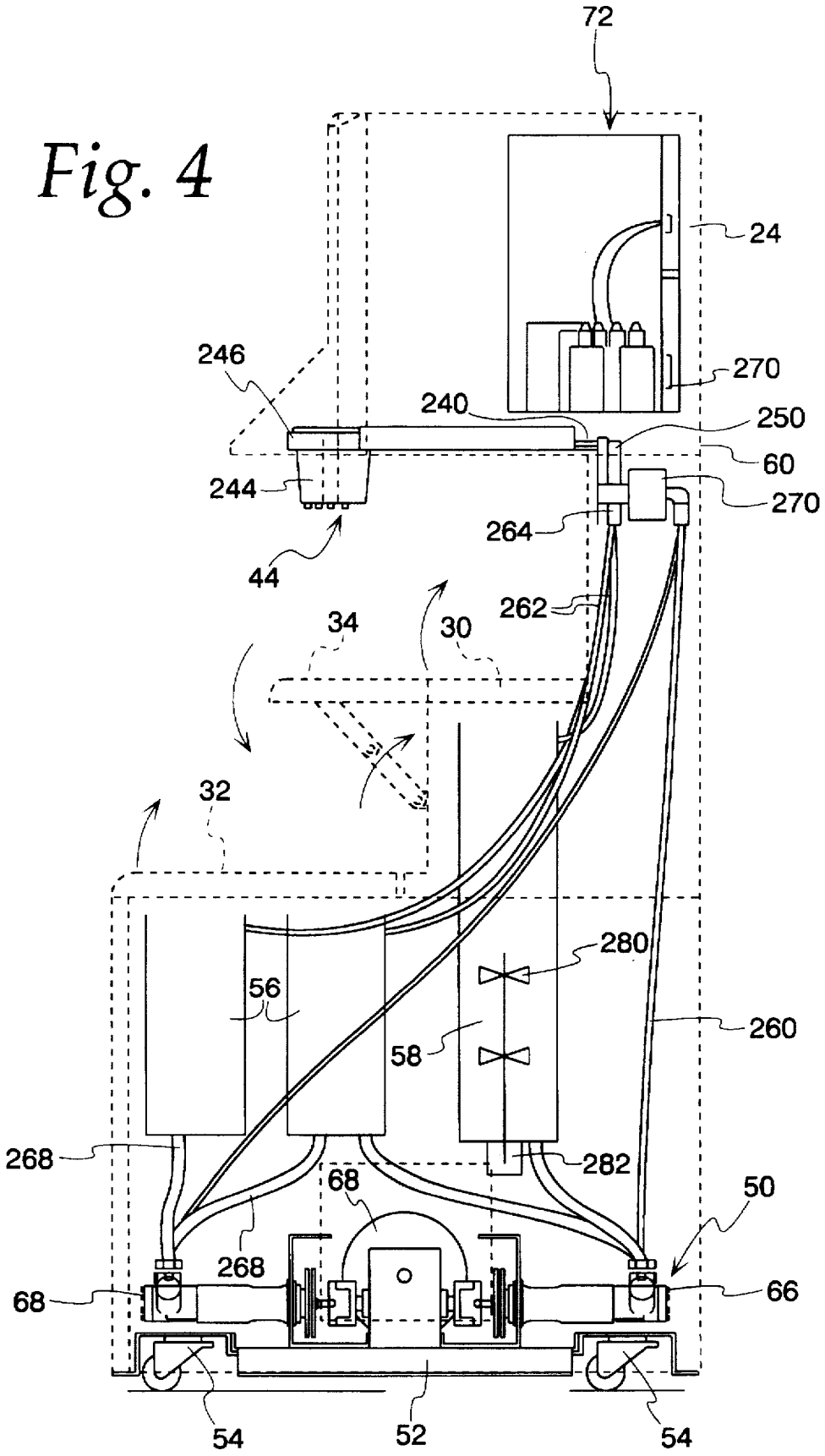
FIG. 4 is a side elevational view of selected components disposed within the outer cabinet.
Figure 5:
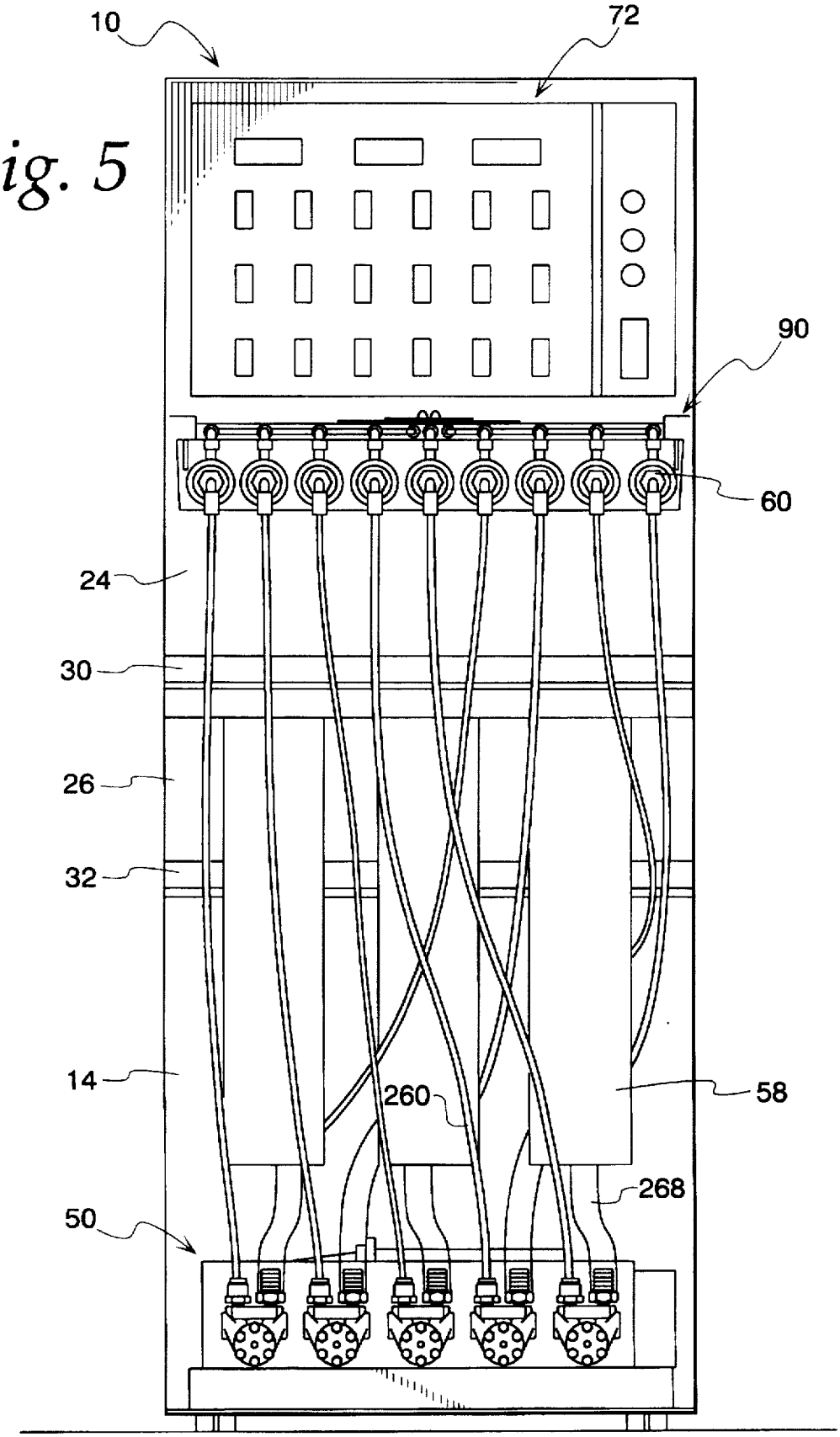
FIG. 5 is a rear elevational view of the dispenser apparatus.

Referring to FIGS. 4 and 5, a pump assembly generally indicated at 50 is mounted on a base plate 52, which includes casters 54 for convenient movement of dispenser 10. As mentioned, the pump assembly 50 is located in the lower cabinet portion 14 and, as can be seen in FIG. 4, is located at the bottommost portion of the dispenser. In the preferred embodiment, two pluralities of canisters, each having a respective uniform size, are employed. An array of shorter canisters 56 is located underneath lower shelf 32 while an array of taller canisters 58 is located underneath access door 30. As indicated in FIG. 4, the canisters and pump assembly are connected through tubing to a plurality of dispense valves 60, preferably located in the bottom part of upper cabinet portion 24. As will be seen herein, the dispense valves 60 and dispense head assembly 44 are mounted together in a modular valve assembly.

Referring again to FIG. 4, pump assembly 50 includes a plurality of pumps 66 coupled to an electric motor 68. The pumps 66 are preferably located in a common horizontal plane lying close to the horizontal centerline of motor 68, so as to provide a "flat" or "low profile" package. As can be seen in FIG. 4, the bottom ends of shorter canisters 56 and longer canisters 58 are generally coterminous, so as to lie generally in a common horizontal plane positioned immediately above the horizontal, low profile assembly 50. As can be seen in FIG. 4, the preferred embodiment of dispenser 10 includes three rows of canisters, two rows of shorter canisters and a row of longer canisters. In the preferred embodiment, each row is three canisters deep, with the dispenser having a total of nine canisters. If desired, each row of canisters could be made four canisters deep to provide a total of twelve canisters, with only a small size increase being required for the additional canisters.

Figure 6:
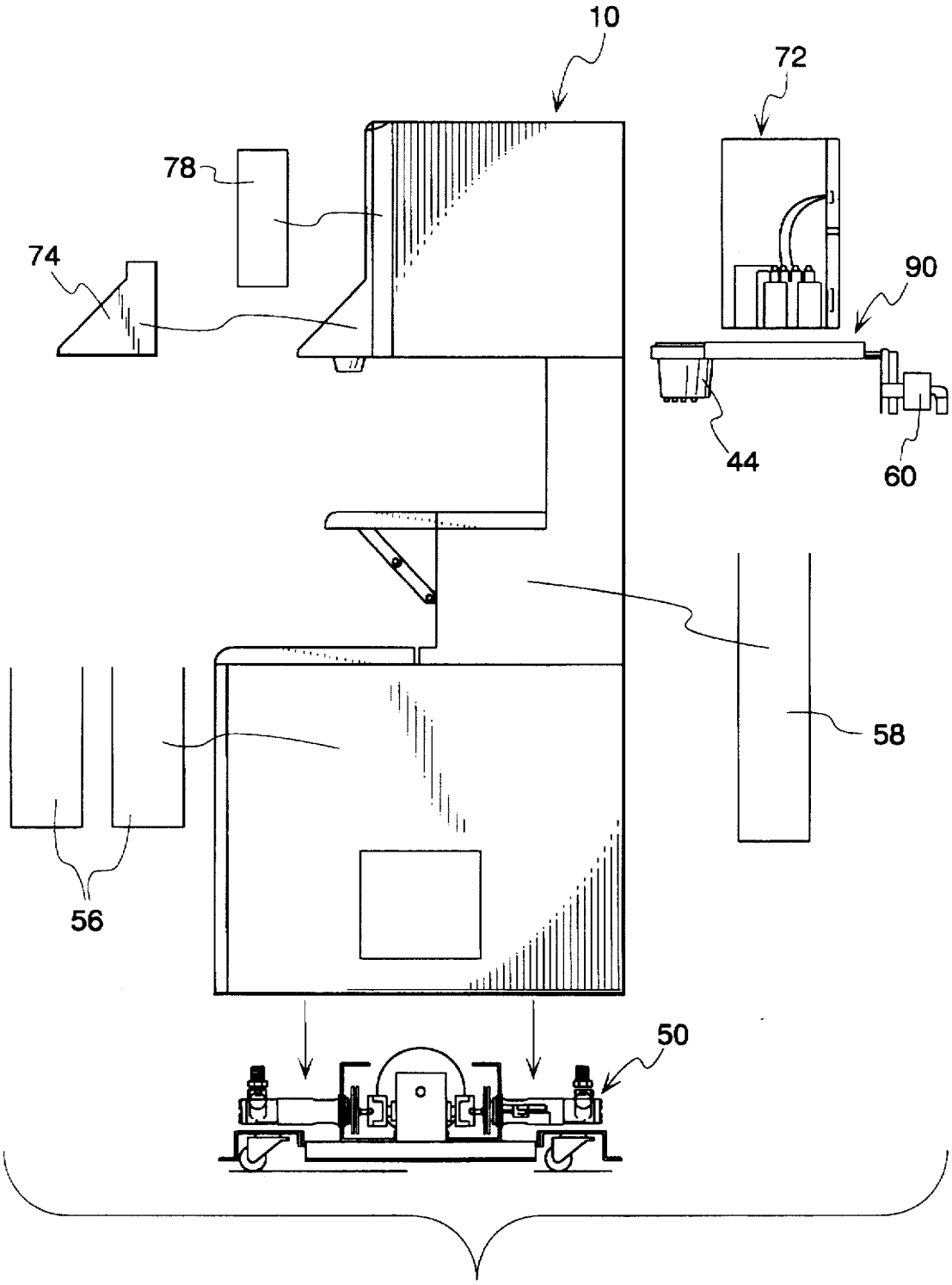
FIG. 6 is an exploded side elevational view of subassemblies of the dispensing apparatus.

Referring now to FIG. 6, electronic control components generally indicated at 72 are installed in the upper part 24 of the dispenser cabinet. The electronic components include a microprocessor controller and associated circuitry for receiving commands from a keyboard 74 mounted in the front part of cabinet portion 24. The control circuitry is coupled to shaft encoders 102 on pumps 66 (see FIG. 7) to monitor the amounts of materials being dispensed during a controlled operation. In the preferred embodiment, the pumps are operated apart from the controlled dispense cycles so as to circulate materials between the pumps, the dispense valve 60 and the canisters 56, 58. The control circuitry is also coupled to dispense valve 60 to initiate and terminate a dispense operation, preferably by diverting circulating flow through the dispense valves to dispense head assembly 44. The control circuitry includes the necessary memory to story a variety of control operations. In the preferred embodiment, the formulations for a particular family of materials being dispensed is stored in a separate formula storage device 78, which also includes a visual display 80 for outputting data to an operator. Data is also outputted in hard copy form via a printer 82 mounted on the front of upper cabinet portion 24, alongside the formula storage device 78, and is also indicated by visual display 83.

In the preferred embodiment, the dispense valves 60 and dispense head assembly 44 are mounted on a common valve tray subassembly generally indicated at 90. As will be seen herein, the valve tray subassembly 90 can be fabricated externally, on a bench or assembly line environment. The electronics components 72 are likewise remotely fabricated, and brought to the machine assembly site, along with formula storage device 78, keyboard 74 and printer 82. The canisters are preferably arranged in two arrays, a first array for the six shorter canisters 56 and a second array for the three longer canisters 58.

Significant construction advantages have been attained by fabricating the pump assembly 50 separately, as a separate subassembly unit. The cabinet with the aforementioned components is preferably erected separately and is brought to the dispenser assembly site as a complete unit, where it is merged with the pump assembly 50 to form the dispenser 10 (see FIG. 6).

Substantial advantages can be attained with the modular constructions identified above. For example, a basic dispensing machine can be designed ahead of time, awaiting a particular customer order. Depending upon the materials to be dispensed by the customer, various components of the basic design may have to be substituted. For example, large volume dispensing operations may best be served by a dispense system having greater throughput rates. For example, if a larger capacity dispense head is required, a special valve tray assembly can be fabricated on a bench, and tested as a working unit prior to installation in the dispenser cabinet. Similarly, larger capacity pumps may be required and/or a larger capacity motor or a motor operating at a faster speed may be desired for a particular installation. It is a much simpler matter to substitute the desired components of the pump assembly on a test bench. If desired, several different versions of subassemblies can be stocked to meet most customer's requirements, and the lead time required for supplying custom built machines can be drastically reduced with the modular construction of the present invention. Additionally, the designers of the machine can arrange the elements of the pump assembly more densely than would otherwise be practically feasible.

Figure 7:
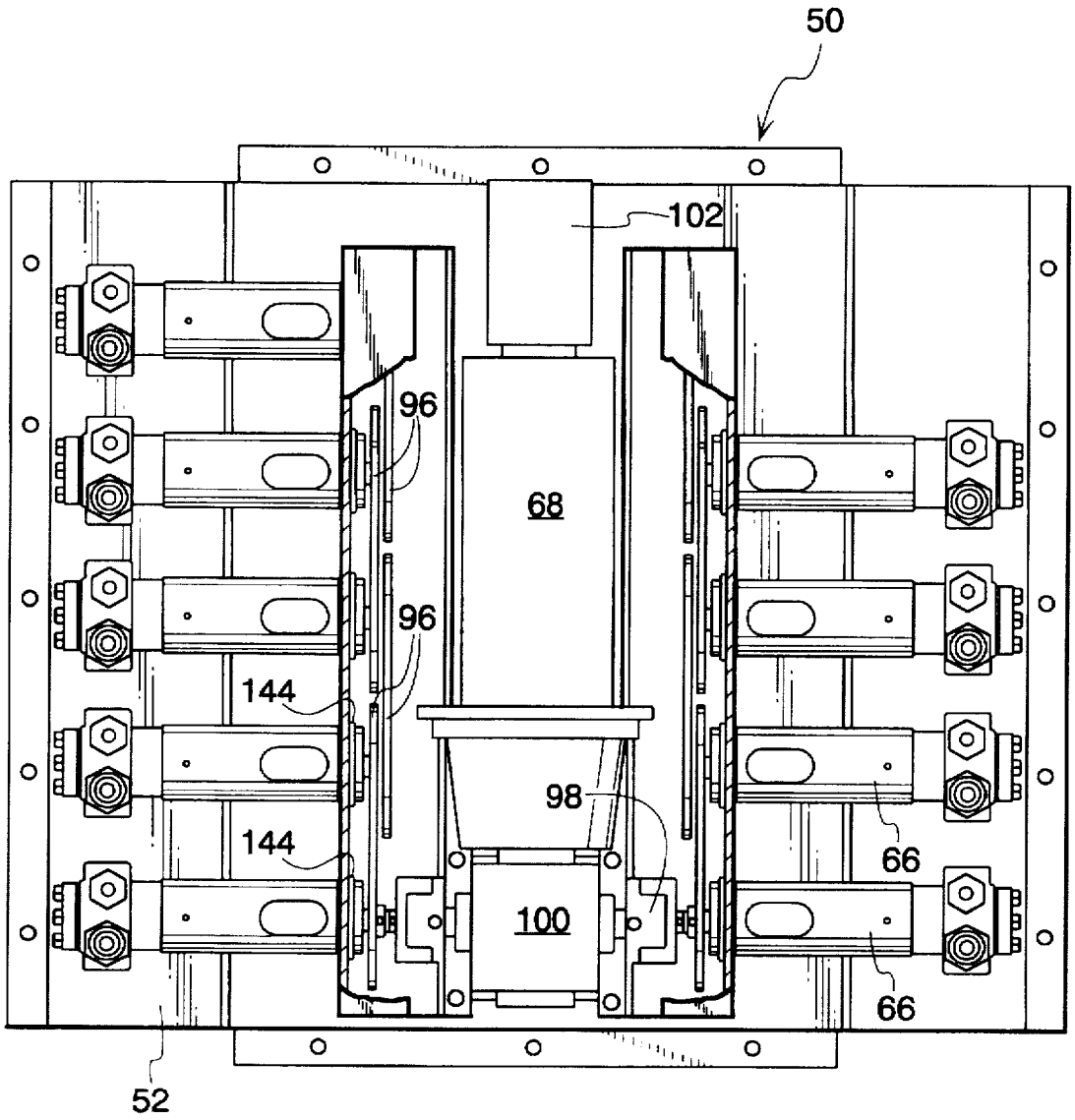
FIG. 7 is a top plan view of pump subassembly thereof.
Figure 8:
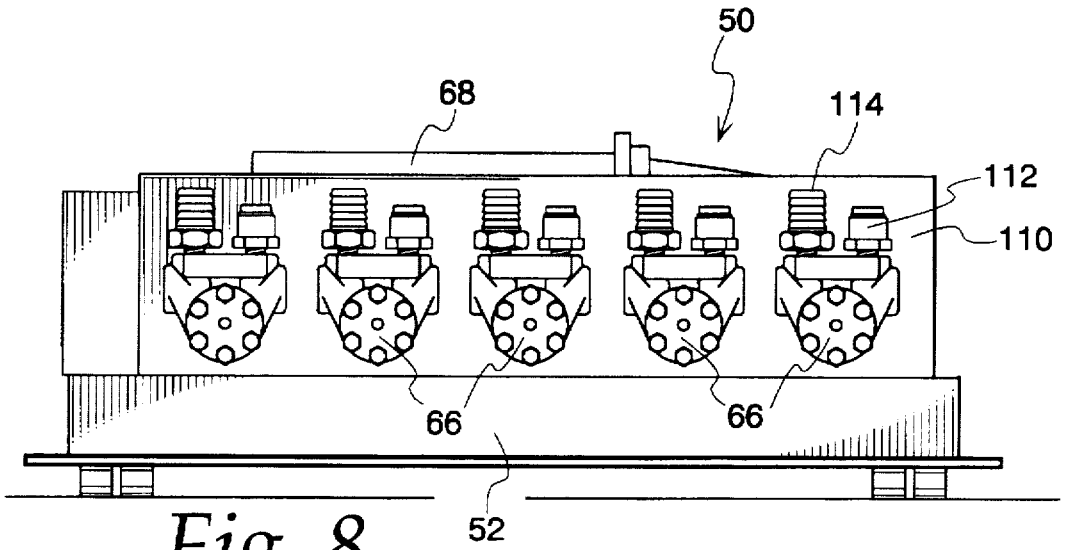
FIG. 8 is a side elevational view thereof.
Figure 9:
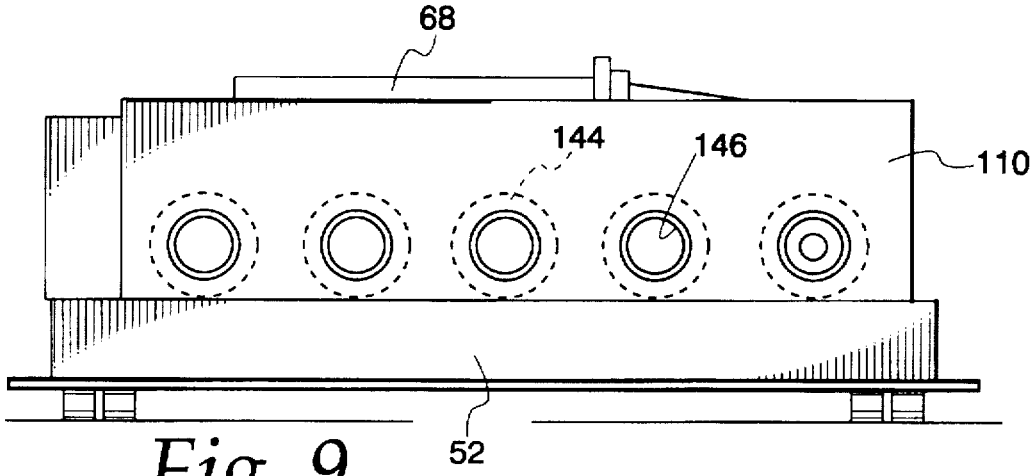
FIG. 9 is a side elevational view similar to that of FIG. 8, but prior to installation of the pumps.
Figure 10:
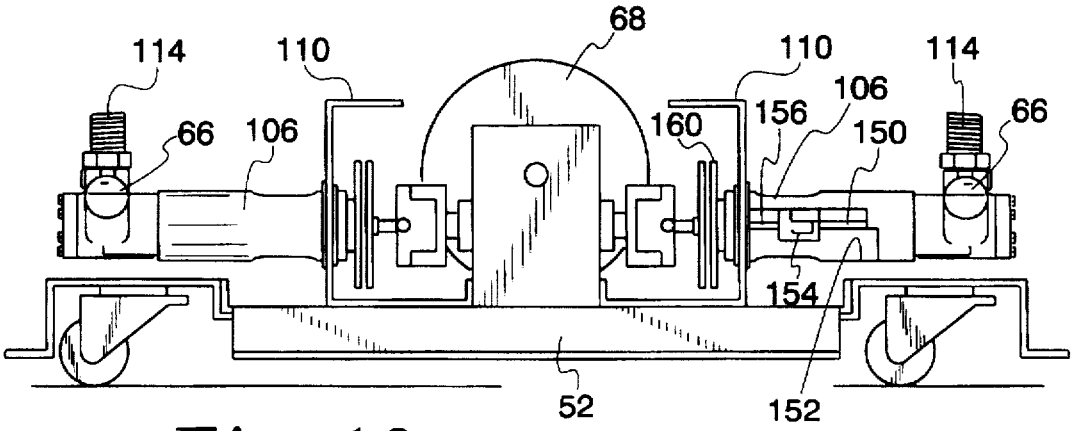
FIG. 10 is a front elevational view of the pump subassembly.

Referring now to FIGS. 7–10, the pump assembly 50 will be described in greater detail. As mentioned above, motor 68 and pumps 66 are coupled together (i.e., either directly or indirectly connected) on a common base plate 52. If desired, a motor could be provided for each pump, for direct connection therewith. As can be seen in FIGS. 7 and 10, for example, the pumps 66 are indirectly connected to the motor through intervening elements, including a series of interengaging chain loops 96. The pumps are preferably arranged in two spaced-apart serial arrays, one on each side of motor 68. Except for the pumps located at the ends of the serial arrays, pumps 66 are connected to pairs of chain sprockets so as to form a drive system in each serial array, driven from a single point in the array (preferably at the drive shafts coupled to the end pumps shown at the bottom of FIG. 7). Connecting members 98 connect the sprocket drive shafts to a transmission member, preferably a gear box 100. A pulse encoder 102 informs the control circuitry of the rotation of the pumps 66.

Referring to FIG. 10, the pumps 66 are mounted by sleeves 106 to mounting walls 110 which are preferably C-shaped in cross section. As can be seen in FIG. 10, the pumps 66 are cantilevered from mounting walls 110. Referring additionally to FIGS. 11 and 12, the pumps 66 include an inlet port 112 and an outlet port 114. The pumps 66 have an outer housing 120 with a first end 122 remote from sleeves 106, and a second end 124 which includes a mounting hub 126 with an annular recess 128. The mounting hub 126 fits within a first end 130 of mounting sleeve 106 and is held in place by a set screw (not shown), the inner tip of which is received in recess 128. Sleeves 106 include a second end 134 which is stepped, having a large diameter outer surface portion 136, a smaller diameter externally threaded surface portion 138 and a stepped wall 140 therebetween. In the preferred embodiment, the stepped wall 140 comprises a reference surface for locating the pump sleeve on mounting walls 110.

FIG. 9 shows mounting wall 110 prior to installation of the pump sleeves therein. In the preferred embodiment, weld nuts 144 are welded to an inner surface of mounting channel 110, in registry with apertures 146 formed in the mounting wall. The pump sleeves are threadingly engaged with the mounting wall, as if they were a bolt. The pump mounting head is then installed in the open free end of the mounting sleeve and secured with the aforementioned set screw. As can be seen in FIGS. 11 and 12, the pump shaft 150 extends into the inner bore 152 of the mounting sleeve. Couplings 154 (see FIG. 10) join the pump shaft 150 with the drive shaft 156 of sprockets 160, thus completing connection to the drive motor. As can be seen in FIG. 11, for example, an inspection port 164 facilitates assembly of the coupling 154.

As can be seen in the side elevational view of FIG. 8, the pump assembly 50 is of a low profile design, with centerlines of the pumps and of the motor lying in closely spaced horizontal planes. The pump arrays are horizontally oriented, as is the drive shaft and outer body of motor 68.

The construction of pump 66, of the mounting sleeve 106 and of the arrangement of the weld nuts 144 and mounting channels 110 cooperate to provide heretofore unattainable reduction in pump wear. The pump and pump mounting arrangements described herein are believed to more accurately align the rotational axes of the pump and associated mounting systems, then mated to form the pump assemblies 50. The reduced wear and improved alignment, however, need not be employed with gang-driven pumps, as shown in the pump assembly 50, but could be employed where a single pump is driven by a power source, such as an electric motor.

Figure 14:
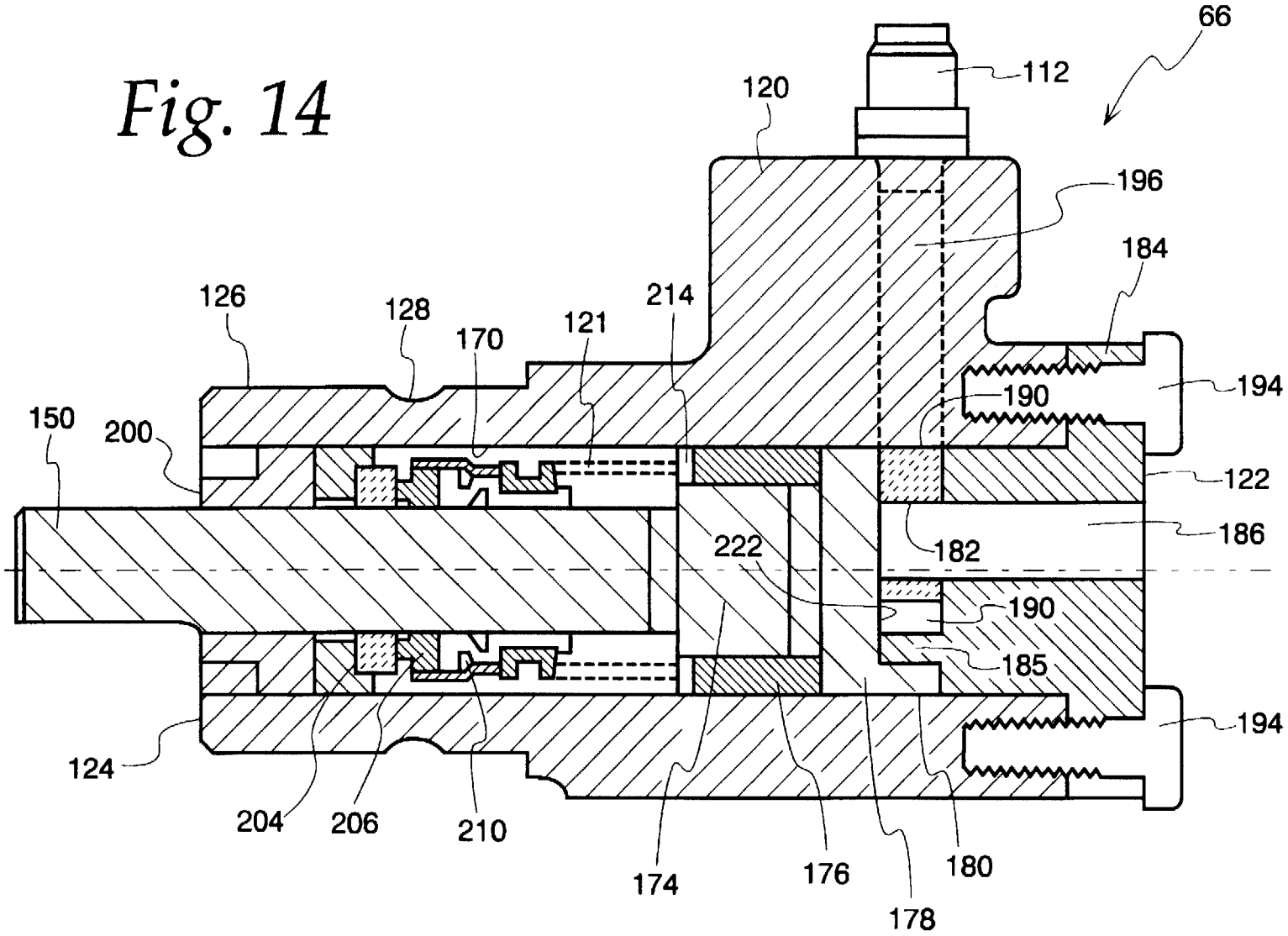
FIG. 14 is a cross-sectional view taken along the line 14—14 of FIG. 11.
Figure 15:
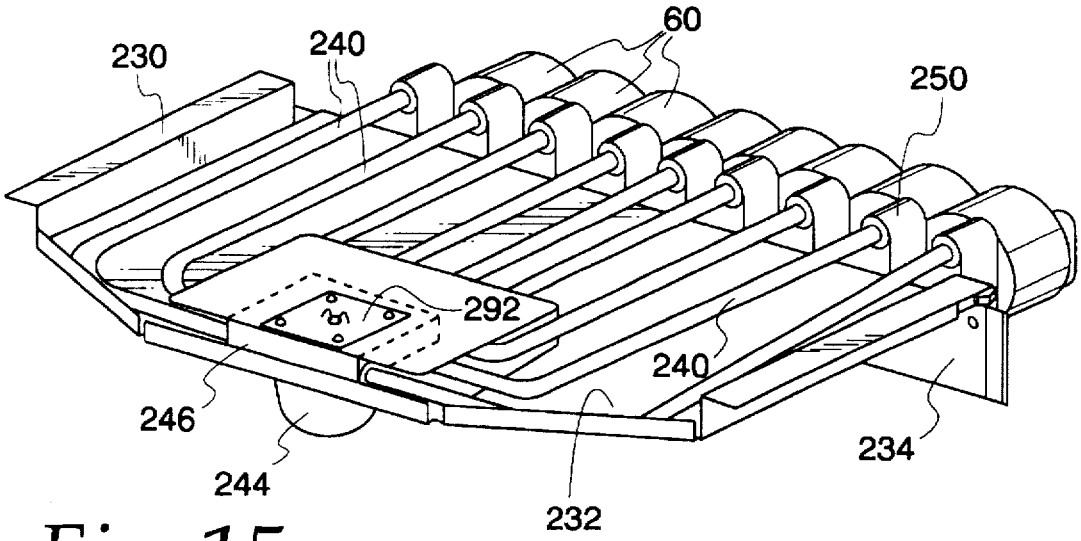
FIG. 15 is a perspective view of the valve tray assembly thereof.

The pump 66 shown in FIG. 14 includes the aforementioned outer housing 120 having a first end 122, a second end 124 and an internal bore 170. As can be seen in FIG. 14, the drive shaft 150 extends beyond the mounting hub 126. Shaft 150 has an enlarged diameter portion 174 supported by sleeve bearings mounted within internal bore 170. The sleeve bearings 176 are located immediately adjacent a rotor 178 which is formed at the interior end of shaft 150. The rotor 178 appears L-shaped in cross section since it is not symmetric about a midplane passing through the center of the rotational axis. In the preferred embodiment, the rotor 178 has nine drive teeth 180 (visible in FIG. 14 as one leg of the "L"). An idler gear 182 is mounted for rotation to a head member 184 by a pin 186. The idler gear 182 is also preferably not symmetrical when viewed in cross section. In FIG. 14, the idler gear includes gear teeth 190. In FIG. 14, a gear tooth cut by the cross section appears above pin 186, while a valley between adjacent gear teeth is located below pin 186. Head 184 is secured to housing 120 by a series of bolts 194. Inlet and outlet passageways are formed in housing 120, on diametrically opposed side portions of idler gear 182. The head 184 includes a wall 185 between the inlet and outlet passageways. An inlet passageway 196 is shown in phantom in FIG. 14.

The pump 66 includes a second sleeve bearing 200 adjacent the exposed free end of the pump shaft 150. Head 184 maintains fluid-tight enclosure of internal bore 170 at the first end of pump 66. In order to maintain a fluid-tight closure at the second end of the pump, a pair of seals are employed. FIG. 14 shows seals 204, 206 which have engaging mating faces. Typically, one seal rotates with drive shaft 150, while the other seal remains stationary, although other arrangements are also possible. For example, both seals could be allowed to rotate with drive shaft 150 with appropriate provision of rotational mounting for the seal located adjacent bearing 200. Seal 206 is mounted in a holder 210 which preferably engages the out surface of the rotor shaft. A spring 212 is positioned between bushing 176 and holder 210, so as to bias the seals 204, 206 together, in mating engagement. A washer 214 is located between spring 212 and bushing 176 to reduce wear.

Initially, there is little or no "end play" in the drive shaft 150. However, with prolonged use, some end play may develop, and spring 212 presses the rotor head into engagement with the idler gear, and also presses the free ends of rotor teeth 180 into engagement with the mating face of head 122. In the preferred embodiment, the idler gear 182 and mounting pin 186 are of hardened construction, preferably hardened cast iron, and most preferably ceramic. The rotor and especially the teeth 180 are also of hardened construction, preferably hardened cast iron. The head 122 is also of hardened construction, preferably hardened cast iron of greater hardness than the rotor, so as to provide continuous adjustments during prolonged pump use (with attendant wear on the rotor 178 and head 122), so as to maintain a constant pump output over the useful life of the pump.

In the preferred embodiment, the idler gear 182 is made of ceramic material and has a hardness greater than that of the head and rotor. The head member is fabricated so as to have an intermediate hardness of the three parts, that is, a lesser hardness than idler gear 182 but a greater hardness than the rotor 178. After prolonged use, the free ends of rotor 180 will wear, so as to have a reduced length in the axial direction. The idler gear 182 sees an increased pressure applied by rotor 178 and, being harder than the rotor, bores into the face 222 of the rotor, thereby effectively extending the length of rotor teeth 180 in the axial direction, as well as the slots between adjacent rotor teeth, thereby preserving the volume pumped for a given amount of rotation. Because the head member 122 is harder than the rotor, a compensating wear develops at the rotor face 222 rather than at the head member 122.

Referring now to FIGS. 15–22, the valve tray subassembly includes a mounting plate 230 in the form of a tray having a horizontal plate-like portion 232 and a downturned rear wall 234. The dispense head assembly 44 is mounted at the forward end of the tray, and is coupled to the dispense valves 60 by a plurality of tubing segments 240. Referring additionally to FIG. 21, the dispense head assembly 44 includes a nozzle portion 244 downwardly depending from a body portion 246 which is preferably formed from a plastic block, machined to form flow channels, one for each conduit 240 extending to the nozzle 244.

Figure 16:
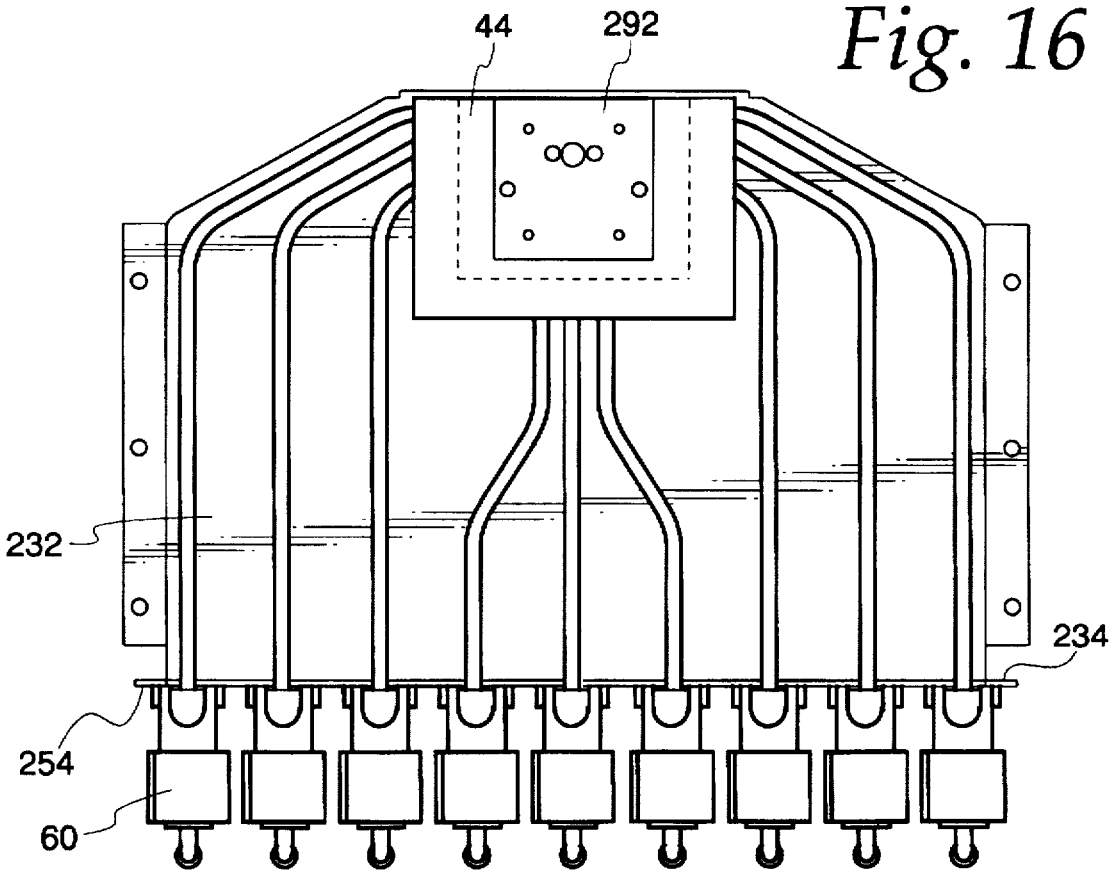
FIG. 16 is a top plan view thereof.

In the preferred embodiment, three flow channels emerge from each sidewall and from the rear wall of the body portion 246. The tubing segments are arranged side-by-side and are trained to generally follow the horizontal plate portion 232 of tray 230. As can be seen in FIG. 16, the tubing segments "fan out" from the sidewalls and rear wall of the body member 246. The tubing segments are connected to dispense ports 250 of the valve 60. In the preferred embodiment, dispense valves 60 are mounted directly to rear wall 234 of tray 230.

However, as indicated in FIG. 16, the dispense valves 60 could be mounted to an intermediate plate 254 which is in turn mounted to rear wall 234. The mounting plate 254 has elongated mounting holes (not shown) to receive threaded fasteners (not shown) received in rear wall 234. Mounting plate 254 can be moved small amounts in a vertical direction, so as to control the amount of slope, if any, to the tubing segments 240. In the alternative embodiment shown in FIG. 16, the mounting plate 254 can be repositioned so as to introduce or alternatively eliminate a small downward slope in the tubing segments, as desired. The tubing segments should be of flexible construction to allow these adjustments.

Referring additionally to FIG. 4, the pump outputs are connected through conduits 260 to the inlet ports of dispense valves 60. Conduits 262 couple the outlet ports 264 to canisters 58, with conduits coupling the canisters to the pump inlet ports. In the preferred embodiment, material to be dispensed is stored in canisters 56, 58 and is pumped through conduits 260 to dispense valves 60. The dispense valves 60 are configured such that the material circulates through the dispense valves, exiting through outlet ports 264 to return to canisters 56, 58 via conduit 262. When a dispensing cycle is initiated, control circuitry 72 initiates commands to dispense valves 60 through conductors 270, and flow is diverted through outlet ports 250, for passage through tubing segments 240 and dispense head 268 to dispense nozzle 244. The recirculation prevents settling in the various conduit lines, and also prevents settling in the canisters, augmenting the stirrers 280, driven by electric motor 282 (see FIG. 4).

A lamp 290 is mounted to printed circuit board 292 which is secured to the upper surface of dispense head 246. The lamp 290 is received in a passageway 294 formed at the center of the dispense head 246 and the dispense nozzle 244, so that illumination from lamp 290 indicates the desired positioning of a container to receive dispense materials. Referring to FIG. 21, stainless steel nozzle extensions 298 are positioned at the bottom end of dispense nozzle 244, the nozzle extensions projecting small amounts beyond the bottom surface 300 of the dispense nozzle. The flow passageways in the dispense nozzle 244 and dispense head 246 are indicated in phantom in FIG. 21.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An improved gear pump, comprising:

a housing having first and second ends and defining an internal bore, an inlet passageway, and an outlet passageway;

a drive member within the internal bore including a rotor having rotor teeth and a drive shaft extending from the rotor toward the first end of the housing;

a head member at the second end of the housing including a wall between the inlet passageway and the outlet passageway and extending toward the rotor;

an idler gear located within the internal bore having gear teeth interengaging with the rotor teeth to pump fluid from the inlet passageway to the outlet passageway;

mounting means for rotationally mounting the idler gear to the head member;

the head member and idler gear having a preselected hardness greater than that of the rotor.

2. The gear pump of claim 1 wherein the idler gear is made of ceramic material and is rotatably mounted to the pump head member by a pin of ceramic material.

3. The gear pump of claim 2 wherein the pump head member is made of hardened cast iron.

4. The gear pump of claim 2 further comprising a bearing support surrounding the rotor.

5. The gear pump of claim 4 further comprising an other bearing support adjacent the first end of the housing, surrounding the drive shaft.

6. The gear pump of claim 5 further comprising a pair of mating seals adjacent the other bearing, and a bias means for biasing the seals together in sealing engagement with one another.

7. The gear pump of claim 6 wherein the bias means comprises a spring element disposed between the seals and the rotor so as to press the seals together in sealing engagement with one another and to also press the rotor into engagement with the head member.

8. The gear pump of claim 6 wherein at least one of the seals is made of ceramic material.

* * * * *